United States Patent [19]

Ito

[11] Patent Number: 4,946,346

[45] Date of Patent: Aug. 7, 1990

[54] GAS TURBINE VANE

[75] Inventor: Syoko Ito, Kanagawa, Japan

[73] Assignee: Kabushiki Kaisha Toshiba, Kawasaki, Japan

[21] Appl. No.: 247,930

[22] Filed: Sep. 23, 1988

[30] Foreign Application Priority Data

Sep. 25, 1987 [JP] Japan ..... 62-241432

[51] Int. Cl.[5] ..... F01D 5/18

[52] U.S. Cl. ..... 415/115; 416/96 A; 416/97 R

[58] Field of Search ..... 415/115, 116; 416/96 A, 416/97 R, 96 R

[56] References Cited

U.S. PATENT DOCUMENTS

| | | | |
|---|---|---|---|
| 2,779,565 | 1/1957 | Bruckmann | 416/96 A |
| 2,865,598 | 12/1958 | Moseson | 416/96 A |
| 3,384,346 | 5/1968 | Halls et al. | 415/191 |
| 3,806,276 | 4/1974 | Aspinwall | 416/96 A |
| 4,086,021 | 4/1978 | Stenfors | 415/115 |
| 4,105,364 | 8/1978 | Dodd | 415/115 |
| 4,193,738 | 3/1980 | Landis, Jr. et al. | 415/115 |
| 4,403,917 | 9/1983 | Laffitte et al. | 415/115 |
| 4,482,295 | 11/1984 | North et al. | 416/96 A |

FOREIGN PATENT DOCUMENTS

| | | | |
|---|---|---|---|
| 51-69707 | 6/1976 | Japan . | |
| 51-34925 | 9/1976 | Japan . | |
| 80004 | 4/1988 | Japan | 415/115 |

*Primary Examiner*—Edward K. Look
*Assistant Examiner*—John K. Kwon
*Attorney, Agent, or Firm*—Oblon, Spivak, McClelland, Maier & Neustadt

[57] ABSTRACT

A gas turbine vane has a vane airfoil defining a cavity extending along the longitudinal direction of the vane airfoil. A guide cylinder is disposed in the cavity to guide coolant fluid supplied from an external source thereof. A plurality of flowing holes are concentrated substantially centrally with respect to the vane airfoil in the longitudinal direction.

14 Claims, 7 Drawing Sheets

GAS TURBINE VANE

BACKGROUND OF THE INVENTION

FIELD OF THE INVENTION

This invention relates to a gas turbine vane. In particular, it relates to a gas turbine vane structure which must be cooled, and which is used as a first stage for an industrial gas turbine engine.

In a general industrial gas turbine engine, a selfdriving system has been adopted in which a turbine directly drives a compressor to supply air to a combustion apparatus. A most effective method to increase the output efficiency of the gas turbine is to increase the combustion gas temperature. However, the combustion gas temperature is restricted by thermal stress resistivity, high temperature oxidation resistivity or corrosion resistivity of the turbine vane. More specifically, the temperature is restricted by the materials comprising the stationary and rotary vanes used in the first stage.

Thus, in a conventional gas turbine, vanes are provided with a cooling structure to cool the vane from the inside using a coolant fluid, as shown in FIG. 6. FIG. 6 shows an example of a first stage stationary vane of a gas turbine, and is a longitudinal sectional view taken on a camber line of a vane body. FIG. 7 is a transverse sectional view taken on a line A—A of FIG. 6. This vane is composed of a vane airfoil i, an upper end wall 2 and a lower end wall 3. A cavity 4 extended along the longitudinal direction of the vane airfoil 1 is formed within the vane airfoil 1. A guide cylinder 5 to guide the coolant fluid is supported on the upper end wall 2 and is disposed into the cavity 4.

The coolant fluid enters the guide cylinder 5 from an impingement plate 6 and cools the upper end wall 2. A part of the coolant fluid flows out from upper film cooling holes 7 and film-cools the surface of the upper end wall 2. The remaining coolant fluid is led to the guide cylinder 5 and flows out from impingement holes 8 drilled along the whole surface of the longitudinal direction. This fluid impingement-cools an inner surface 9 of a leading edge of the vane. As shown in FIGS. 6 and 8, protrusions 10 disposed parallel to each other in a chord direction are provided on an inner surface of the vane airfoil 1. Protrusions 10 have rectangular sections and are arranged parallel and at the same intervals to each other.

The lengths of protrusions 10 are substantially the same as the width of the guide cylinder 5. Protrusions 10 disposed on the inner surface of the vane airfoil 1 and the outer surface of the guide cylinder 5 are adhered closely. Cooling ducts 11 are defined as the spaces surrounded by the inner wall of the vane airfoil held between adjacent protrusions 10, side walls 15 of the protrusions 10 and the outer surface 16 of the guide cylinder 5. The coolant fluid impinging on the inner surface of the leading edge of the vane airfoil I flows to the trailing edge of the vane. As a result, the coolant fluid convection-cools the vane airfoil 1 from its inner surface, and flows out of the vane through gaps between pin fins 12 formed on the trailing edge to accelerate the convection effect.

In the lower end wall 3, similarly, the coolant fluid entering from an lower impingement plate 13 impingement-cools the lower end wall 3. Thereafter, the coolant fluid flows out from lower film cooling holes 14 and film-cools the surface of the lower end wall 3.

However, there are several problems with the above-mentioned conventional vane. Namely, the coolant fluid temperature rises considerably when the coolant fluid reaches the trailing edge through cooling ducts 11. As a result, the cooling effect is decreased on the trailing edge. Besides, the temperature distribution of the main flow of combustion gas is shown in FIG. 9. Furthermore, the thermal stress also increases because the temperature distribution of the vane airfoil grows larger. Therefore, the temperature of the vane surface also becomes highest near the center area in the longitudinal direction of the vane, and the temperature distribution of the vane surface is spread widely.

It is necessary to maintain the average temperature of the vane airfoil 1 and the maximum temperature at the limited part at a permissible value. Therefore, if a cooling design is performed to keep the temperature of the center area of the vane within the permissible value, the upper and lower sides of the vane become supercooled. As a result, effective cooling is not performed, because the imbalance of the thermal distribution causes thermal stress. Thus, the above-mentioned conventional vane has a problem in not being able to be cooled with a small temperature difference on the vane surface using effectively the coolant fluid.

SUMMARY OF THE INVENTION

An object of this invention is to provide an improved gas turbine vane having an excellent cooling performance, utilizing low thermal stress, and being applicable to the gas turbine for high temperature.

Briefly, in accordance with one aspect of this invention, there is provided a gas turbine vane. The gas turbine vane comprising a vane airfoil, a cavity extended along the longitudinal direction of the vane airfoil. A guide cylinder is disposed in the cavity to guide the coolant fluid applied from the outside of the vane airfoil. A plurality of flowing holes are drilled along the chord·direction of the vane airfoil only near the center area of the longitudinal direction of the guide cylinder.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 5A:
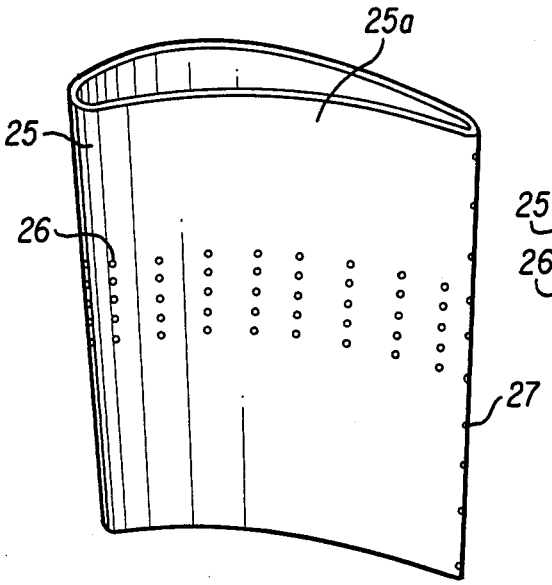
FIGS. 5*a* and *b* are perspective views different kinds of guide cylinders of the vane of FIG. 1.

Reference now will be made in detail to the present preferred embodiments of the invention, examples of which are illustrated in the accompanying drawings. In accordance with the invention, a vane is composed of a vane airfoil 21, an upper end wall 22 and a lower end wall 23 integrally formed with the vane airfoil 21. The vane airfoil 21 defines a cavity 24 which approximates the shape of an outer airfoil. The cavity 24 is formed in the vane airfoil 21, and extends along the longitudinal direction of the vane airfoil 21. The cavity 24 is defined as the space surrounded by the vane airfoil 21 and the upper and lower end walls 22 and 23. A guide cylinder 25 is supported by welding to the upper end wall 22, and is disposed in the cavity 24. The guide cylinder 25 has a bottom disposed toward the lower end wall 23, and the top of the guide cylinder 21 opens beside the upper end wall 23. Impingement holes 26 are drilled substantially only in the center area of the longitudinal direction of the vane along the whole area of the chord direction of the vane airfoil 21, as shown in FIG. 5. In addition, fine holes 27 are drilled along the longitudinal direction of the trailing edge of the vane airfoil 21.

Figure 1:
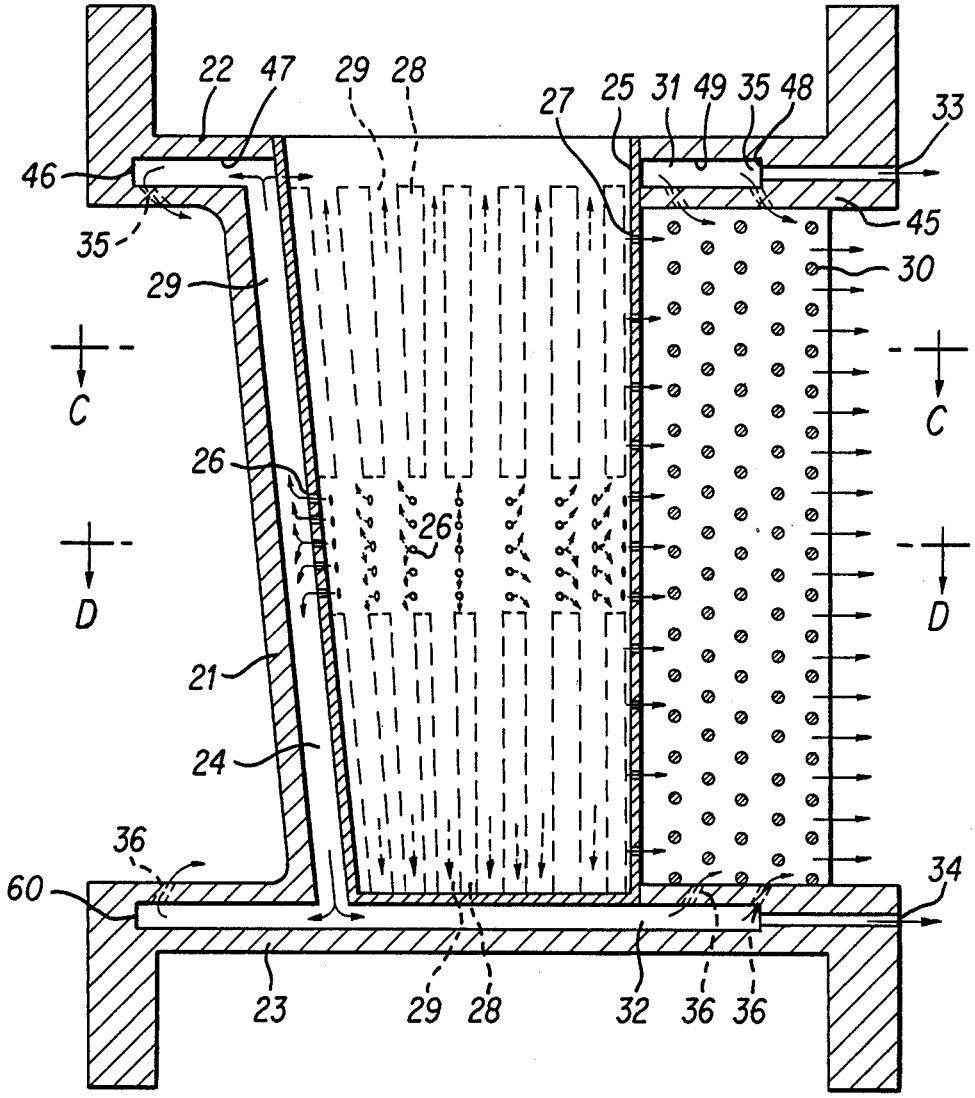
FIG. 1 is a longitudinal sectional view taken on a vane shape of a gas turbine vane of an embodiment of this invention.
Figure 2:
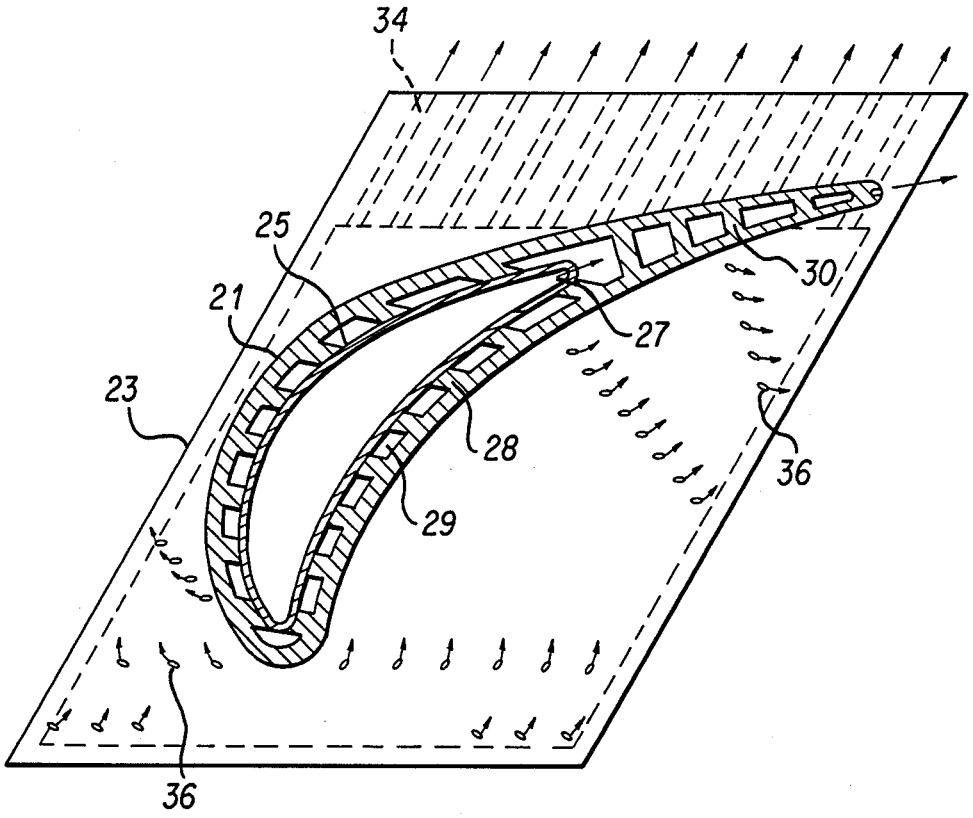
FIG. 2 is a transverse sectional view taken in the direction of the arrows substantially along the line C—C of FIG. 1.
Figure 3:
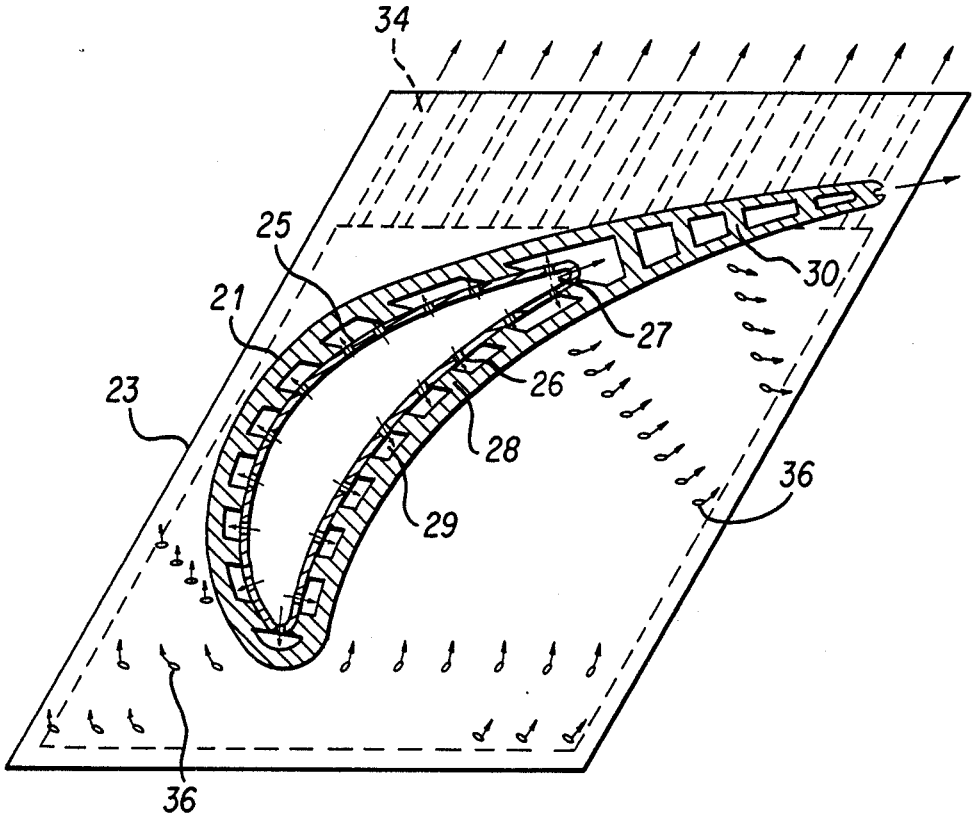
FIG. 3 is a transverse sectional view taken in the direction of the arrows substantially along the line D—D of FIG. 1.
Figure 4:
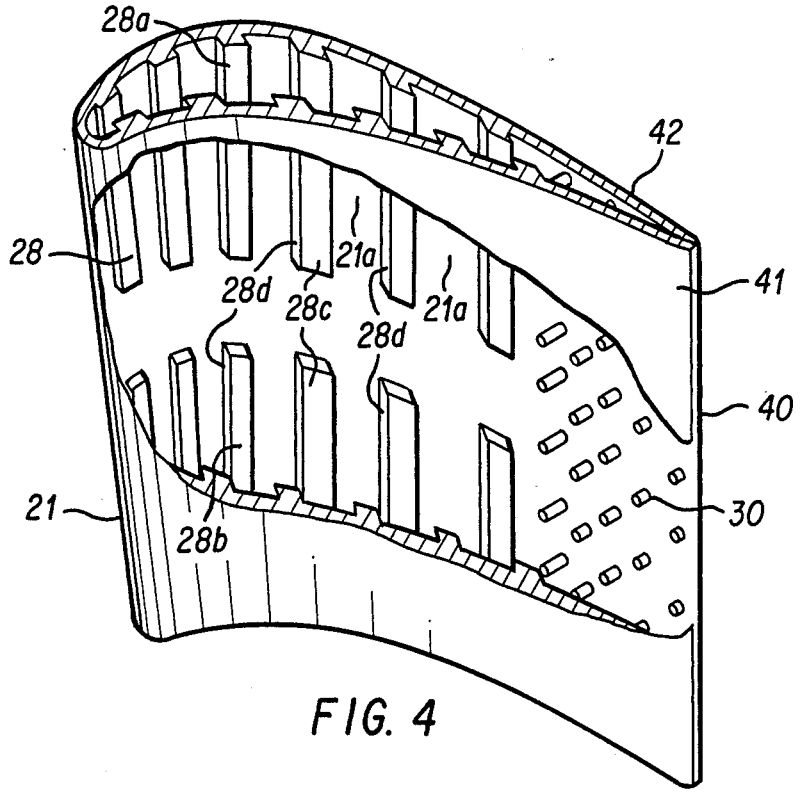
FIG. 4 is a perspective view to the vane airfoil of FIG. 1 with a portion partially broken away.

As shown in FIG. 4, protrusions 28 are provided parallel to each other on the inner surface of the vane airfoil 21 along the longitudinal direction of the vane except at the center area. Each protrusion 28 has a rectangular section and an equal height, and is formed integrally with the vane airfoil 21. Protrusions 28 are arranged having substantially the same interval therebetween on the inner surface of the vane airfoil 21. Upper protrusions **28*a* and lower protrusions 28*b* are disposed facing each other across the width of the impingement holes 26, drilled on the guide cylinder 25 (shown in FIGS. 4 and 5**).

Figure 5B:
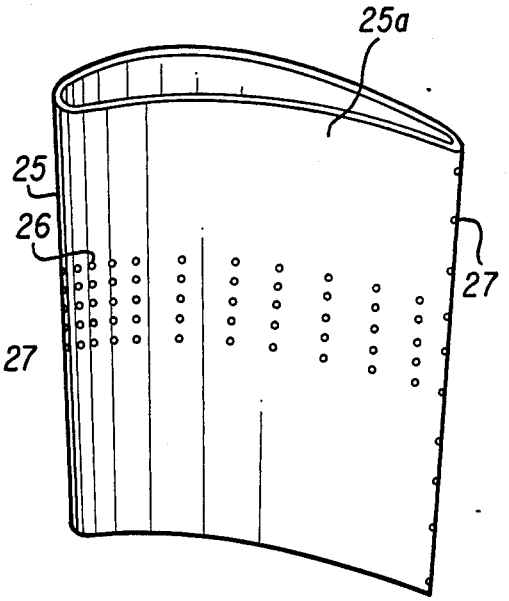
Figure 6:
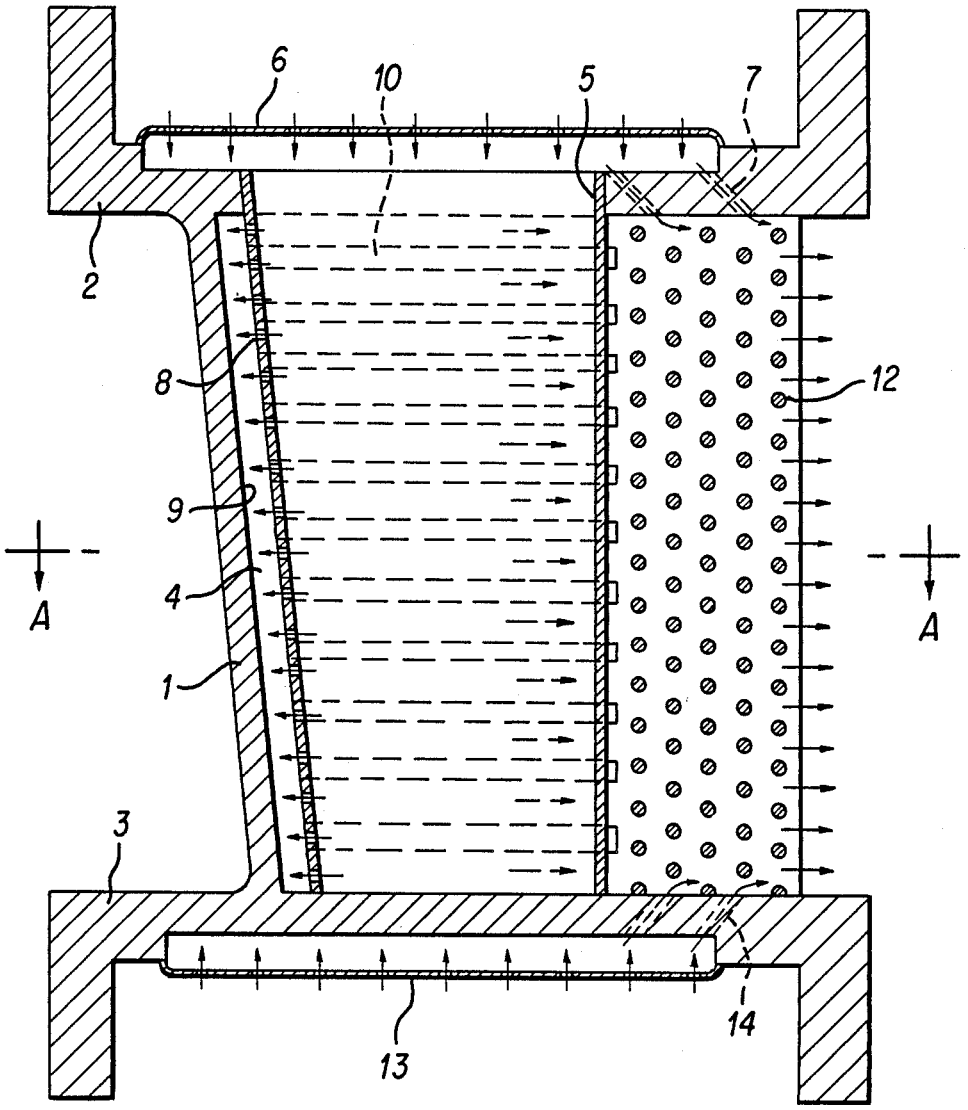
FIG. 6 PRIOR ART
FIG. 6 is a longitudinal sectional view taken of a vane shape of a conventional gas turbine vane.
Figure 7:
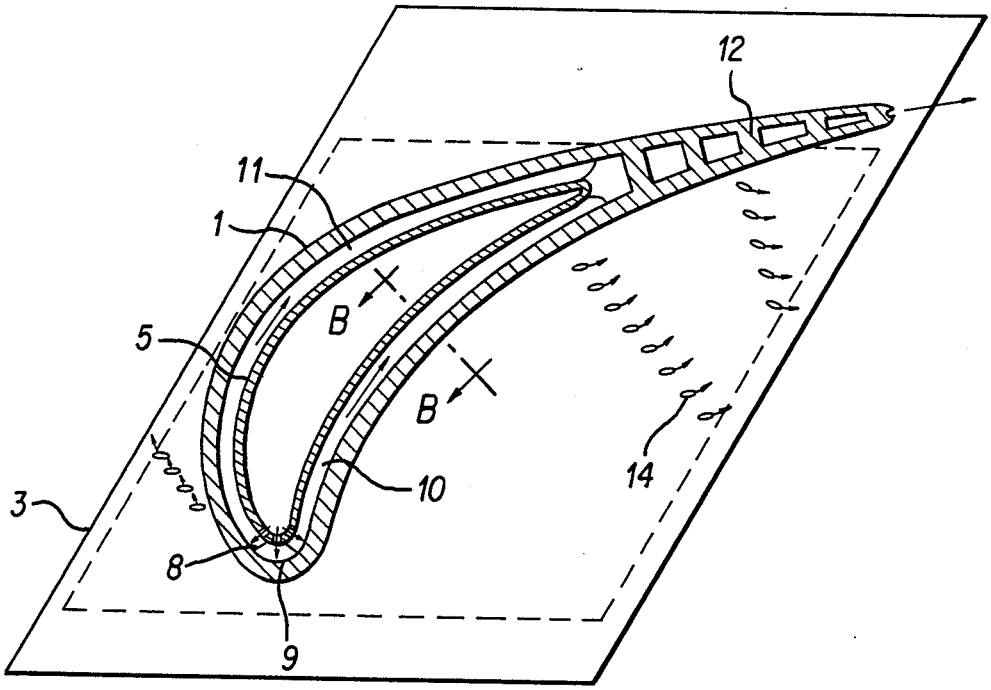
FIG. 7 PRIOR ART
FIG. 7 is a transverse sectional view taken in the direction of the arrows substantially along the line A—A of FIG. 6.
Figure 8:
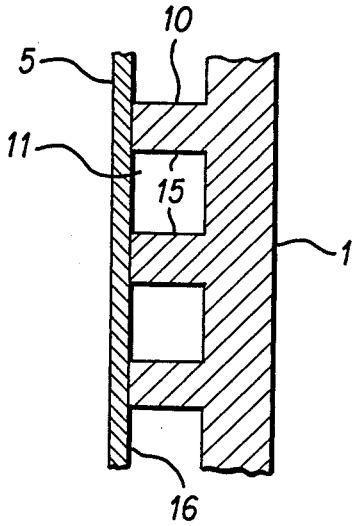
FIG. 8 PRIOR ART
FIG. 8 is a sectional view taken in the direction of the arrows substantially along the line B—B of FIG. 6.
Figure 9:
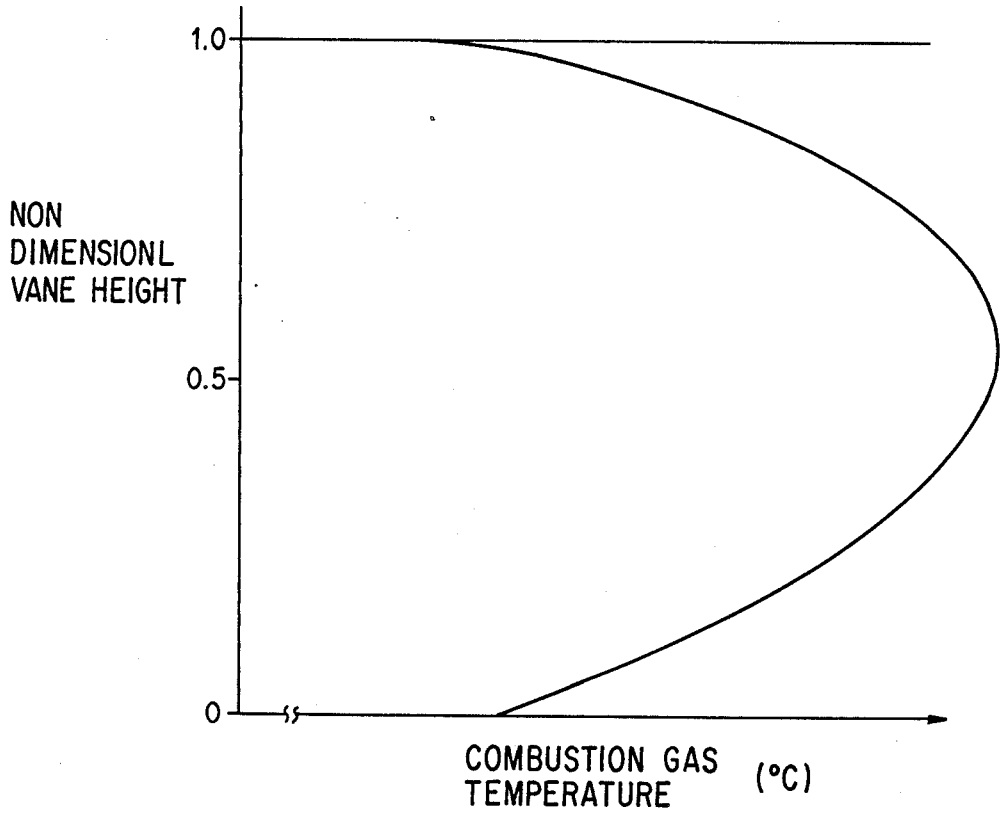
FIG. 9 PRIOR ART
FIG. 9 is a graphical representation showing the thermal distribution of a combustion gas at the entrance of the conventional vane arrangement of FIG. 6.

Thus, the impingement holes 26 shown in FIG. **5*a* having the same intervals between each other. However, as shown in FIG. 5*b*, the impingement holes 26 may be disposed so as to have narrower intervals near at the leading edge. The length of the area disposing protrusions 28 is substantially equal to the length in the chord direction of the guide cylinder 25. Cooling ducts 29 are formed between the protrusions 28 and the outer surface of the guide cylinder 25 The tops 28*c* of protrusions 28 adhere closely to the outer surface 25*a* of the guide cylinder 25**.

Cooling ducts 29 are defined by the side walls **28*d* of upper and lower protrusions 28*a* and 28*b*, inner surfaces 21*a* of the vane airfoil 21 and the outer surface 25*a* of the guide cylinder 25. Pin fins 30 are formed on the trailing edge of the vane airfoil 21 extending over the whole chord and longitudinal directions. Namely, pin fins 30 are provided on the inner surface of the vane airfoil 21 between the protrusions 28 and the trailing edge 40 of the vane airfoil 21, and provided across the side walls 41, 42 of the vane airfoil 21. As a result, the lengths of pin fins 30 become smaller toward the trailing edge 40 of the vane airfoil 21**.

Furthermore, upper and lower flow paths 31 and 32 connected commonly to cooling ducts 29 are formed into upper and lower end walls 22 and 23. Upper and lower flow paths 31 and 32 extend through upper and lower end walls 22 and 23. The upper flow path 31 opens into a plurality of upper exhaust holes 33 on one end of the upper end wall 22. The lower flow path 32 opens a plurality of lower exhaust holes 34 on the same end of the lower end wall 23.

In the upper end wall 22, a plurality of upper film-cooling holes 35 for film-cooling the high temperature gas side surface of the upper end wall 22 connect with the upper flow path 31. Each upper film-cooling hole 35 is provided in a wall 45 of the upper flow path 31, and each cooling hole 35 is obliquely oriented. As a result, the coolant fluid ejected from film-cooling holes 35 provided on the front 46 of the upper flow path 31 film-cools the gas side surface 47 of the upper end wall 22. The coolant fluid ejected from film-cooling holes 35 provided on the rear 47 of the upper flow path 31 film-cools the rear inner surface 49 of the upper end wall 22. Similarly, a plurality of lower film-cooling holes 36 for film-cooling the inner surface 50 of the lower end wall 23 are connected to the lower flow path 32.

Protrusions 28 provided on the inner surface **21*a* of the vane, and the vane airfoil 21, including the pin fins 30 and upper and lower end walls 22 and 23, are manufactured using monobloc precise casting techniques. The guide cylinder 25 is manufactured by drilling after the formation working e.g., the sheet metal processing. Thereafter, it is disposed into the vane airfoil 21 and fixed by welding to the upper end wall 22**.

According to the above-mentioned construction of the embodiment of the invention, the coolant fluid flowing into the guide cylinder 25 is ejected from impingement holes 26 toward the inside of the vane airfoil 21, and impinge-cools the center area of the longitudinal direction of the vane airfoil 21. Thereafter, the coolant fluid is separated in the longitudinal direction through the cooling ducts 29 to flow towards opposite ends of the guide cylinder 25. On the other hand, additional coolant fluid flowing out independently from fine holes 27 provided in the guide cylinder 25 is directed out of the vane through the pin fins 30. As a result, the trailing edge 40 of the vane airfoil 21 is sufficiently cooled by the coolant fluid supplied directly on the trailing edge 40 of the vane airfoil 21. The coolant fluid flowing into the cooling ducts 29 of the vane airfoil 21 convection-cools the inside of the vane airfoil 21 through the cooling ducts 29, and is led into the upper flow path 31 provided in the upper end wall 22.

A part of the coolant fluid flowing into the upper flow path 31 flows out from upper film cooling holes 35 drilled at the combustion gas side, and film-cools the surfaces 41, 42 of the trailing edge of the vane airfoil 21. Additional coolant fluid flows out from the upper exhaust holes 33 provided on the trailing edge of the upper end wall 22. The coolant fluid flowing into the cooling ducts 29 flows similarly into the lower flow path 32 and flows out of the vane from lower film-cooling holes 36 and the lower exhaust holes 34.

According to above-mentioned vane construction, uniformalizing of the vane surface temperature distribution has been realized and the thermal stress has been also lightened because the coolant fluid is ejected concentratively on the part which is apt to increase to the highest temperature. Simultanuously, a cooling efficiency the same as that of the conventional vane has been achieved using less coolant fluid than in the conventional vane.

Furthermore, in above-mentioned embodiment of this invention, the coolant fluid has been caused to flow out from the trailing edges of the end walls. As a result, the end walls can be cooled while the sealing between the stationary and rotary vanes for the combustion gas using the flowed out coolant fluid, and the coolant fluid is conserved.

What is claimed is:

1. A fluid-cooled turbine vane, comprising:

a vane airfoil;

a cavity within the vane airfoil extending along the longitudinal direction thereof; and a guide cylinder in the cavity for guiding coolant fluid supplied into the cylinder from an external source thereof, the guide cylinder including hole means for ejecting coolant fluid toward the inside of the vane airfoil for cooling, said holes means being concentrated substantially centrally with respect to the vane airfoil in the longitudinal direction of the vane airfoil.

2. The vane of claim 1 the hole means is extending along the chord direction of the guide cylinder.

3. The vane of claim 1 wherein the guide cylinder includes a longitudinally extending trailing edge, and a plurality of holes in the guide cylinder along the trailing edge.

4. The vane of claim 1 wherein the hole means includes a plurality of holes in the guide cylinder centrally arranged in spaced relation surrounding substantially the entire surface.

5. The vane of claim 4 wherein said means for separating said coolant fluid comprises a plurality of spaced longitudinally extending protrusions, each pair of adjacent protrusions cooperating with the guide cylinder to form one of the cooling ducts.

6. The vane of claim 1 also including a plurality of cooling ducts to guide the coolant fluid, and providing between the vane airfoil and the guide cylinder.

7. The vane of claim 1 wherein the vane airfoil has upper and lower end walls.

8. The vane of claim 7 wherein each upper and lower end wall includes a flow path therein.

9. The vane of claim8 wherein the flow paths are connected to the cooling ducts.

10. The vane of claim 1 wherein the vane airfoil is a stationary vane.

11. The vane of claim 1 wherein intervals of the hole means are narrowed near the leading edge of the guide cylinder.

12. A fluid-cooled vane turbine, comprising:

a vane airfoil;

a cavity within the vane airfoil extending along the longitudinal direction thereof;

a guide cylinder in the cavity for guiding coolant fluid supplied into the cylinder from an external source thereof, the guide cylinder including hole means for ejecting coolant fluid toward the inside of the vane airfoil for cooling, said hole means being concentrated substantially centrally and surrounding the entire surface with respect to the vane airfoil in the longitudinal direction of the vane airfoil, and a plurality of spaced longitudinally extending protrusions, each pair of adjacent protrusions cooperating with the guide cylinder to form one of the cooling ducts.

13. The vane of claim 12 wherein the central area is disposed corresponding to the plurality of holes.

14. The vane of claim 12 wherein the protrusions are substantially parallel to each other.

* * * * *